US006634287B2

(12) United States Patent
Mizutani et al.

(10) Patent No.: US 6,634,287 B2
(45) Date of Patent: Oct. 21, 2003

(54) STENCIL DISPOSAL BOX

(75) Inventors: Tomohiro Mizutani, Ibaraki-ken (JP); Atusi Kanai, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 31 days.

(21) Appl. No.: 09/968,840

(22) Filed: Oct. 3, 2001

(65) Prior Publication Data

US 2002/0040655 A1 Apr. 11, 2002

(30) Foreign Application Priority Data

Oct. 5, 2000 (JP) ..... P2000-306404

(51) Int. Cl.[7] ..... B41L 13/06
(52) U.S. Cl. ..... 101/114; 101/116
(58) Field of Search ..... 101/114, 116–120, 101/477, 479, 483

(56) References Cited

U.S. PATENT DOCUMENTS 5,575,213 A * 11/1996 Kawai et al. ..... 101/477
5,713,274 A * 2/1998 Kawai et al. ..... 101/114
6,067,901 A * 5/2000 Takahashi ..... 101/114
6,345,576 B2 * 2/2002 Furutsuka ..... 101/477

FOREIGN PATENT DOCUMENTS

JP 2547498 Y2 9/1997

* cited by examiner

*Primary Examiner*—Ren Yan
(74) *Attorney, Agent, or Firm*—Gary M. Nath; Harold L. Novick; Marvin C. Berkowitz

(57) ABSTRACT

A stencil disposal box is detachably provided to a stencil printing machine main body, and used stencil sheets are stored therein when the stencil disposal box is mounted to the stencil printing machine main body. An opening, through which a stencil sheet is conveyed, is formed on the stencil disposal box. The stencil disposal box includes a stencil disposal box main body for storing the conveyed stencil sheets, a sweeping member rotatively provided so as to move between an innermost position approximately adjacent to an inner surface of the stencil disposal box main body and a sweeping position located more adjacently to the opening side than the innermost position, and an operation lever portion, which can operate the movement of the sweeping member. This operation lever portion can be operated while gripping a handle portion.

8 Claims, 10 Drawing Sheets

STENCIL DISPOSAL BOX

BACKGROUND OF THE INVENTION

1. Field of the Invention

The present invention relates to a stencil disposal box detachably provided on a main body of a stencil printing machine, in which used stencil sheets are stored.

2. Description of the Related Art

A stencil printing machine functions to print an ink image according to the steps below. Specifically, a thermal head thermosensitively perforates a stencil sheet so as to correspond to a desired image. This thermosensitively perforated stencil sheet is wound around the outer peripheral surface of a printing drum. Then, a print sheet is fed such that the stencil sheet thus wound is pressed onto the print sheet. During this press conveying process, ink is transferred to the print sheet through a perforation of the stencil sheet. In the above-described stencil printing machine, the stencil sheet used for the printing is removed from the printing drum, then the removed stencil sheet is conveyed to the stencil disposal box and stored therein, and then, stencil sheet thermosensitively perforated so as to correspond to a new desired image is wound around the outer peripheral surface of the printing drum. With such a constitution, the stencil printing machine can print new images repeatedly. If the stencil sheet disposal box is filled with the used stencil sheet, it is required to detach the stencil disposal box from the stencil printing machine main body to dispose of the stencil sheet in the stencil sheet disposal box to a wastebasket.

FIG. 1 shows a perspective view of a conventional stencil disposal box, and FIG. 2 shows a sectional view of the same. As shown in FIGS. 1 and 2, a stencil disposal box 100 is constituted of a stencil disposal box main body 101 having an opening 101*a* on the upper side thereof and a sweeping member 102 provided in the stencil disposal box main body 101. This sweeping member 102 has an approximately U-shape and the both ends thereof are rotatably supported by rotation support portions 103 to the stencil disposal box main body 101.

As shown by the solid line in FIGS. 1 and 2, when the stencil box 100 is mounted to a stencil printing machine main body (not shown), the sweeping member 102 is located at a position where it contacts the bottom plane of the stencil disposal box due to its own weight. Also, as shown by the broken line of FIG. 2, when the opening 101*a* of the stencil disposal box 100 is turned downward, the sweeping member 102 rotates due to its own weight so as to separate from the bottom plane.

Next, description will be made for a disposal process of the used stencil sheet 105 contained in the stencil disposal box 100 to a wastebasket 104 with reference to FIG. 3.

When the stencil disposal box 100 is filled with the stencil sheet 105 stored therein, a user detaches the stencil disposal box 100 from the stencil printing machine main body. Then, the user carries this detached stencil disposal box 100 to the position of the wastebasket 104. At a position above the wastebasket 104, the user turns downward the opening 101*a* of the stencil disposal box 100 as shown by the solid and broken lines of FIG. 3. Consequently, the sweeping member 102 rotates due to its own weight so as to separate from the bottom plane of the stencil disposal box main body 101 and pushes the stencil sheet 105 to the side of opening 101*a*. Thus, the stencil sheet 105 drops into the wastebasket 104 (Refer a gazette of Utility Model Registration 2547498).

In this conventional example, even if the used stencil sheet 105 is stuck to the inner surface of the stencil disposal box main body 101 due to viscosity of the ink adhered on the used stencil sheet 105, the sweeping member 102 can drop such stuck stencil sheet 105 easily.

However, in the conventional stencil disposal box 100 described above, the sweeping member 102 rotated due to its own weight. Therefore, in the case where the adhesion force of the ink on the stencil sheet 105 was strong, sometimes the sweeping member 102 could not rotate, and thus, the stencil sheet 105 could not be dropped. Especially, when using the apparatus, in which the stencil sheet 105 is compressed and stored in the stencil disposal box 100, the stencil sheet 105 is apt to adhere strongly due to the ink viscosity. Here, a method that the sweeping member 102 is made heavier or larger may be conceived as a solution therefor. However, the stencil disposal box 100 proportionally becomes heavier or larger, resulting in the undesirable deterioration of the operability thereof.

SUMMARY OF THE INVENTION

The object of the present invention is to provide a stencil disposal box capable of disposing of used stencil sheet, which sticks to the stencil disposal box main body due to ink viscosity, by dropping the same from the stencil disposal box main body surely and easily.

From the first aspect of the present invention, there is provided a stencil disposal box, which is detachably provided to a stencil printing machine main body and stores used stencil sheet when the stencil disposal box is mounted to the stencil printing machine main body. The stencil disposal box is characterized by comprising: a stencil disposal box main body having an opening formed thereon, through which the stencil sheet is conveyed, and storing the conveyed stencil sheet; a sweeping member rotatively provided so as to move between an innermost position approximately adjacent to an inner surface of the stencil disposal box main body and a sweeping position located more adjacently to the opening side than the innermost position; and an operation member for operating movement of the sweeping member.

In this stencil disposal box, when a user turns downward the opening of the stencil disposal box main body and operates the operation member, the sweeping member moves from the innermost position to the sweeping position, and the used stencil sheet stuck to the stencil disposal box main body due to the ink viscosity is forcibly separated therefrom by this moving sweeping member.

In the second aspect of the present invention, the ribs extending in approximately parallel to a conveying direction of the stencil sheet are further provided on the inner surface of the stencil disposal box main body.

In this stencil disposal box, since the stencil sheet conveyed in the stencil disposal box main body contacts the rib, the contact area between the stencil sheet and the stencil disposal box main body becomes small. Accordingly, the used stencil sheet hardly adheres to the stencil disposal box main body, and even if adhered, the adhesion force is weak.

In the third aspect of the present invention, the ribs are provided on a surface of the sweeping member, to which the stencil sheet contacts.

In this stencil disposal box, since the stencil sheet contacts the rib of the sweeping member when the sweeping member moves from the innermost position to the sweeping position, the contact area between the stencil sheet and the sweeping member is small. Therefore, the used stencil sheet hardly adheres to the sweeping member.

In the fourth aspect of the present invention, the ribs of the sweeping member are set to have a height so as not to protrude from the ribs on the stencil disposal box main body when the sweeping member is located at the innermost position.

In this stencil disposal box, the stencil sheet conveyed in the stencil disposal box main body contacts the rib on the stencil disposal box main body, but does not contact the rib on the sweeping member, and in such a state, the stencil sheet is stored in the stencil disposal box main body. When the stencil disposal box is detached from the stencil printing machine main body and the operation member is operated, the rib on the sweeping member first contacts the used stencil sheet.

In the fifth aspect of the present invention, an urging means for urging the sweeping member to move to the innermost position is further provided.

In this stencil disposal box, even if the user does not return the sweeping member to the innermost position forcibly by operating the operation member after moving the sweeping member to the sweeping position, the sweeping member automatically returns to the innermost position surely due to the urging force of the urging means. Therefore, it is possible to prevent the occurrence of the situation that the sweeping member is not located at the innermost position due to the influence from some external force at the time of mounting the sweeping member to the stencil printing machine main body. Also, when the user turns downward the opening of the stencil disposal box main body so as to drop the stencil sheet, unless the user operates the operation member, the sweeping member is held at the innermost position due to the urging force of the urging means, and the sweeping member does not move even if the user turns downward the opening of the stencil disposal box main body.

In the sixth aspect of the present invention, the operation member is provided in the vicinity of a handle portion of the stencil disposal box main body where a user can operate the operation member while gripping the handle portion.

In this stencil disposal box, a user can easily operate the operation member while gripping the handle with the same hand.

In the seventh aspect of the present invention, the stencil disposal box main body is formed of a bottom plane, side planes disposed on the both sides of the bottom plane and a back plane disposed on the back side of the bottom plane, the ribs are at least provided on the bottom plane, a position adjacent to the back plane of the stencil disposal box main body is set as the innermost position of the sweeping member, the sweeping member rotatively moves to the sweeping position with using an upper end portion of the sweeping member as a rotation center, and a lower end position of the sweeping member is set at least lower than the height of the rib on the bottom plane of the stencil disposal box main body.

In this stencil disposal box, when the sweeping member moves from the innermost position to the sweeping position, the sweeping member surely interferes the used stencil sheet stored in the stencil disposal box main body and moves the stencil sheet toward the opening.

In the eighth aspect of the present invention, the sweeping member has a plurality of sweeping claws along a direction perpendicular to the conveying direction of the stencil sheet.

In this stencil disposal box, the sweeping claws of the sweeping member sweep away the used stencil sheet stored in the stencil disposal box main body by pushing the same at many points.

DETAILED DESCRIPTION OF THE EMBODIMENT

Hereinafter, an embodiment of the present invention will be described based on the drawings.

Figure 1:
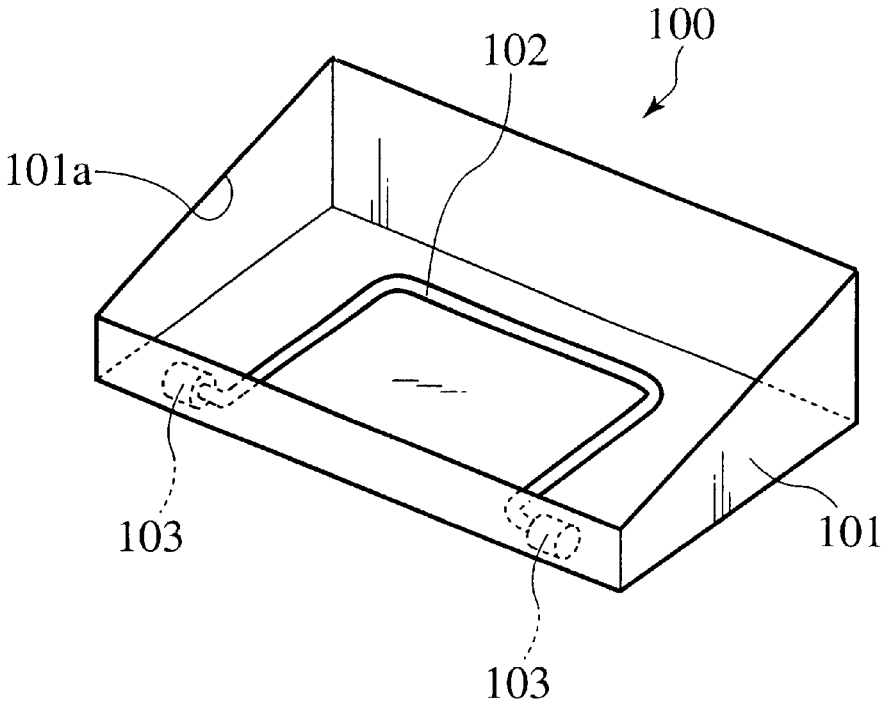
FIG.1 PRIOR ART
FIG. 1 is a perspective view showing a stencil disposal box of a conventional example.
Figure 2:
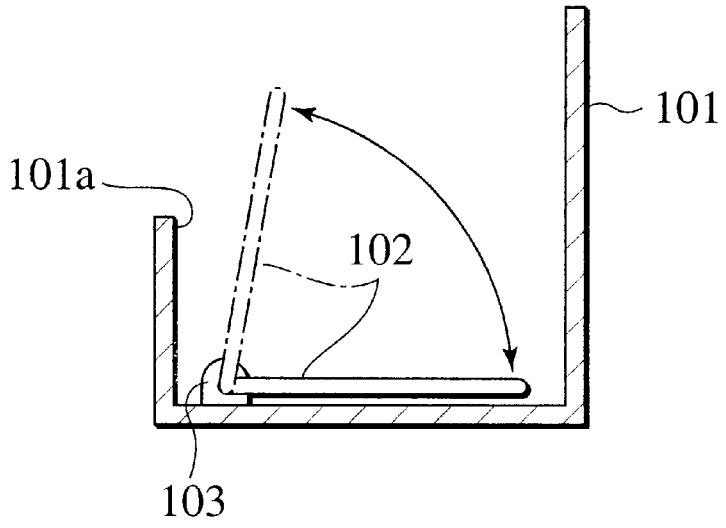
FIG.2 PRIOR ART
FIG. 2 is a sectional view showing the stencil disposal box of the conventional example.
Figure 3:
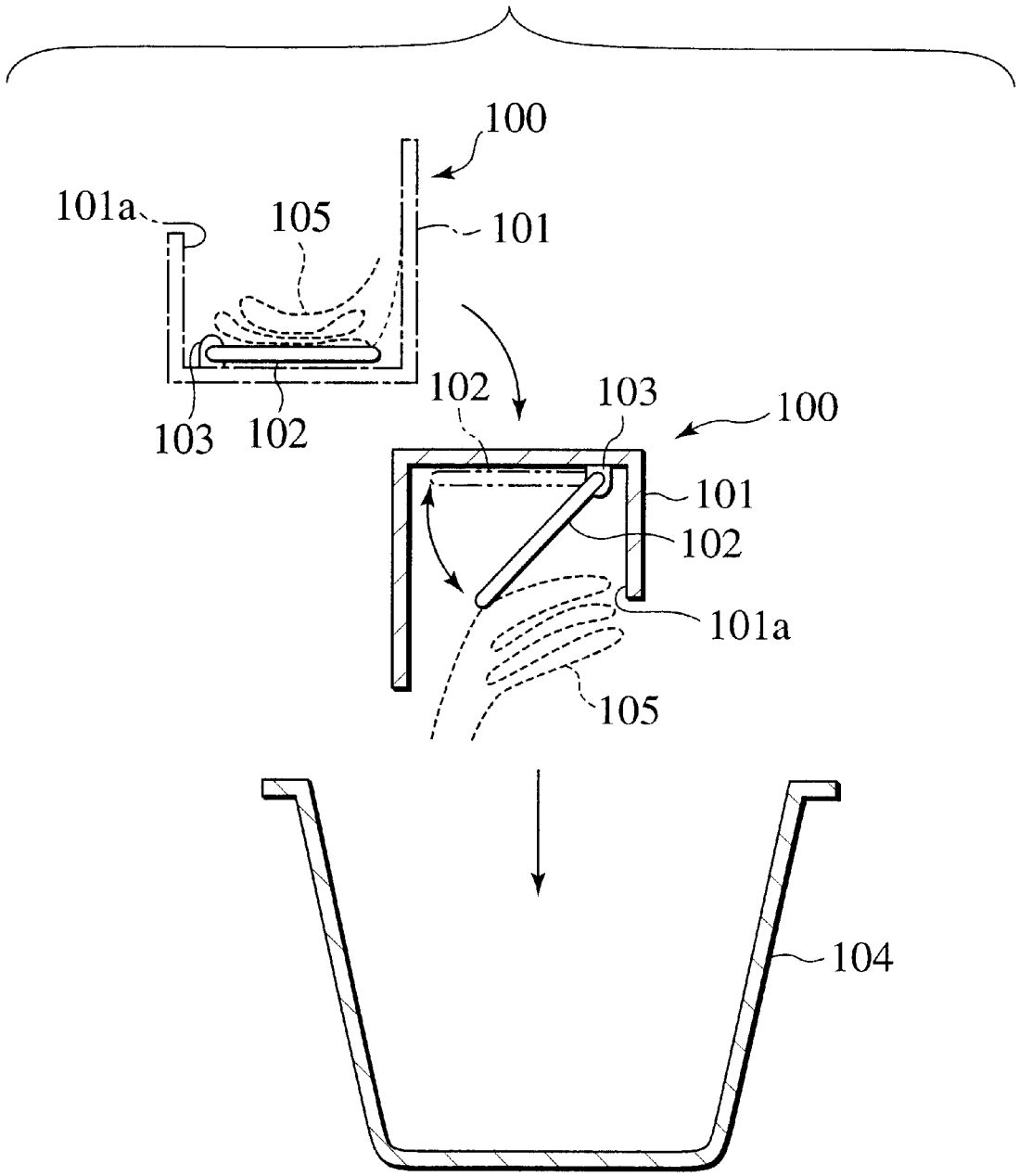
FIG.3 PRIOR ART
FIG. 3 is a sectional view showing a stencil sheet disposal operation by the stencil disposal box of the conventional example.
Figure 4:
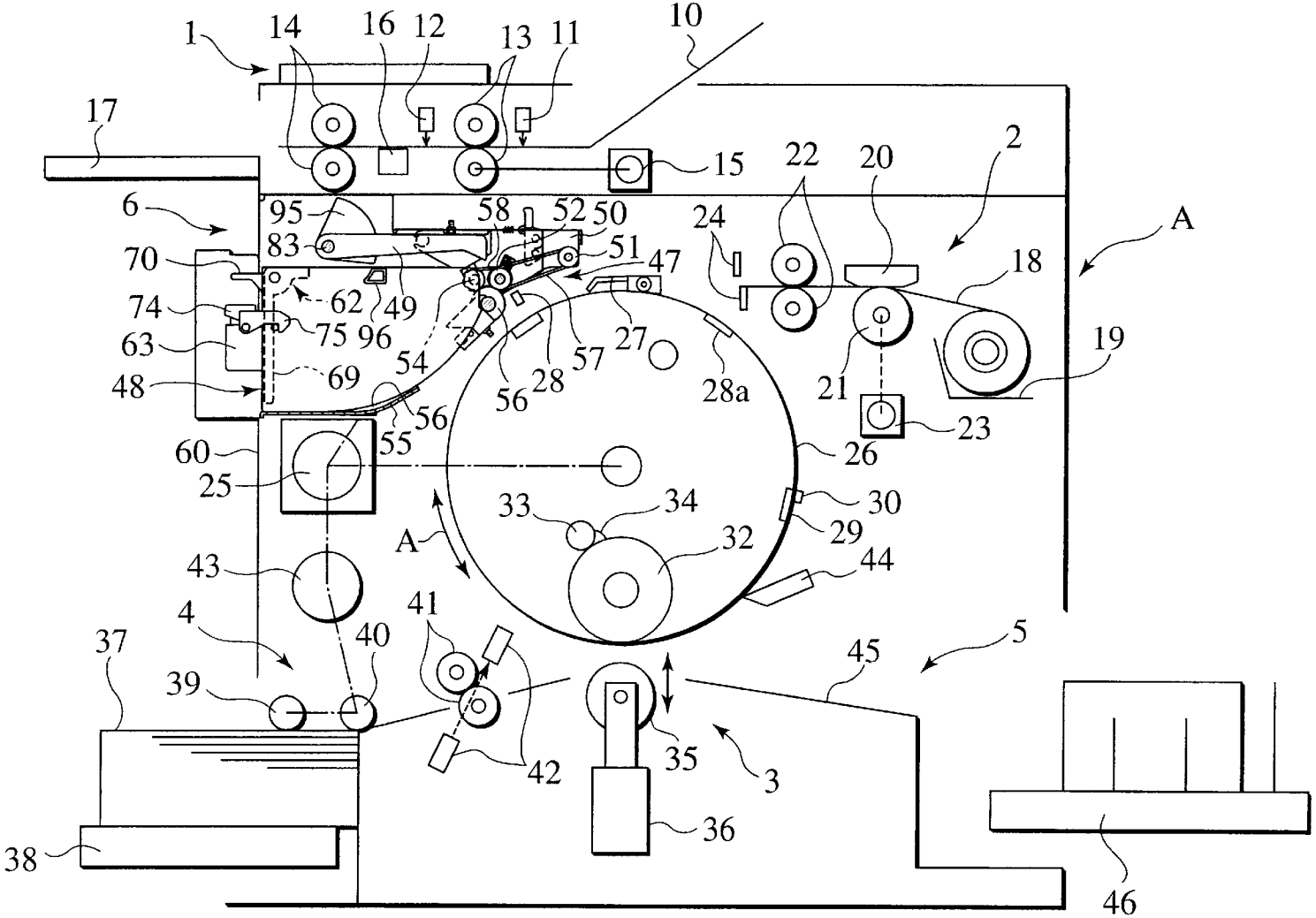
FIG. 4 is a constitutional view schematically showing a stencil printing machine of a first embodiment of the present invention.

As shown in FIG. 4, a stencil printing machine A is mainly constituted of an original-reading unit 1, a stencil making unit 2, a printing unit 3, a paper feed unit 4, a paper discharge unit 5 and a stencil disposal unit 6.

The original-reading unit 1 includes: an original-setting table 10 for placing an original to be printed thereon; reflective original-sensors 11 and 12 for detecting the presence or absence of the original on the original-setting table 10; original-conveying rollers 13 and 14 for conveying the original on the original-setting table 10; a stepping motor 15 for rotary-driving the original-conveying rollers 13 and 14; a contact-type image sensor 16 for optically reading image data of the original conveyed by the original-conveying rollers 13 and 14 and converting the data into electric signals; and an original-discharging tray 17 for placing the original discharged from the original-setting table 10. With such a constitution, the original placed on the original-setting table 10 is conveyed by the original-conveying rollers 13 and 14. The image data of the conveyed original are read by the image sensor 16.

The stencil making unit 2 includes: a stencil sheet container 19 for containing long rolled stencil sheet 18; a thermal head 20 disposed ahead of the stencil sheet container 19 in terms of the sheet conveyance sequence, a platen roller 21 disposed on a position opposite to this thermal head 20; a pair of stencil sheet conveying rollers 22 and 22 disposed ahead of the platen roller 21 and the thermal head 20 in terms of the sheet conveyance sequence; a light pulse motor 23 for rotary-driving the platen roller 21 and the stencil sheet conveying rollers 22; and a stencil sheet cutter 24 disposed ahead of the pair of stencil sheet conveying rollers 22 and 22 in terms of the sheet conveying sequence. With such a constitution, the long stencil sheet 18 is conveyed by the rotation of the platen roller 21 and the stencil sheet conveying rollers 22, and dot heating elements on the thermal head 20 selectively operates to generate heat based on the image data read by the image sensor 16. Then, the stencil sheet 18 is thermosensitively perforated, thus making a stencil. Consequently, the stencil sheet 18 thus obtained is cut by the stencil sheet cutter 24 to fabricate the stencil sheet 18 having a predetermined length.

An outer peripheral portion of the printing unit 3 is formed of an ink permeable member having a porous structure. The printing unit 3 includes: a printing drum 26, which rotates in an arrow A direction shown in FIG. 4 by the driving force of a main motor 25; a stencil sheet clamping portion 27, which clamps an edge portion of the stencil sheet 18 and is provided on the outer peripheral surface of the printing drum 26; a stencil sheet recognizing sensor 28 for recognizing whether or not the stencil sheet 18 is wound and attached to the outer peripheral surface of the printing drum 26 by detecting a detection fragment 28*a* of the printing drum 26; a reference position detecting sensor 30 for detecting a reference position of the printing drum 26 by detecting a detection fragment 29 of the printing drum 26 and a rotary encoder 31 for detecting the rotation of the main motor 25. A rotation position of the printing drum 26 can be detected by detecting an output pulse of the rotary encoder 31 on the basis of the detection output of the reference position detecting sensor 30.

The printing unit 3 further includes: a squeegee roller 32 disposed inside the printing drum 26, and a doctor roller 33 disposed close to the squeegee roller 32. Ink 34 is pooled on the outer peripheral space surrounded by the squeegee roller 32 and the doctor roller 33. The ink 34 adhered to the outer periphery of the rotating squeegee roller 32 passes between the squeegee roller 32 and the doctor roller 33, and thus only the ink 34 having a predetermined film thickness is adhered to the squeegee roller 32. Consequently, the ink 34 having the predetermined film thickness is supplied to an inner peripheral surface of the printing drum 26. Also, a press roller 35 is provided at a position opposite to the squeegee roller 32 and outside the printing drum 26. The press roller 35 is constituted so as to move freely between a pressing position where the press roller 35 presses the outer peripheral surface of the printing drum 26 and a stand-by position where the press roller 35 stays away from the outer peripheral surface of the printing drum 26 by the driving force of a solenoid device 36. The press roller 35 moves from the stand-by position to the pressing position synchronously with the paper feeding operation from the paper feed unit 4. The press roller 35 is located at the pressing position only at the time when print paper 37 passes a lower portion of the printing drum 26 and at the stand-by position during the rest of the time.

Then, the edge portion of the stencil sheet 18 conveyed from the stencil making unit 2 is clamped by the stencil sheet clamping portion 27. In this state, the printing drum 26 is rotated, and thus the stencil sheet 18 is wound around the outer peripheral surface of the printing drum 26. Also, the print paper 37 conveyed synchronously with the rotation of the printing drum 26 from the paper feed unit 4 is pressed onto the stencil sheet 18 on the printing drum 26 by the press roller 35, whereby the ink is transferred through the perforation of the stencil sheet 18 to the print sheet 37, and thus, the printing of the image is completed.

The paper feed unit 4 includes: a paper feed table 38 on which the print paper 37 is laminated; primary paper feed rollers 39 and 40 for conveying only the uppermost print paper 37; a pair of secondary paper feed rollers 41 and 41 for conveying the print paper 37 conveyed by the primary paper feed rollers 39 and 40 to the space between the printing drum 26 and the press roller 35 synchronously with the rotation of the printing drum 26; and a paper feed detection sensor 42 for detecting whether or not the print paper 37 is fed between the pair of secondary paper feed rollers 41 and 41. The primary paper feed rollers 39 and 40 are constituted such that the rotation of the main motor 25 is selectively transmitted to the primary paper feed rollers 39 and 40 via a paper feed clutch 43.

The paper discharge unit 5 includes: a paper separator claw 44 for separating the print paper 37, which is subjected to a printing process, from the printing drum 26; a conveyance path 45 through which the print paper 37 separated from the printing drum 26 by the paper separator claw 44 is conveyed; and a paper receiving tray 46, on which the print paper 37 discharged from the conveyance path 45 is placed.

The stencil disposal unit 6 includes: discharged stencil conveying means 47, which guides the edge portion of the stencil sheet 18 released from the clamp and separated from the outer peripheral surface of the printing drum 26 and then conveys the guided used stencil sheet 18 while peeling from the printing drum 26; a stencil disposal box 48 for storing the stencil sheet 18 conveyed by the discharged stencil conveying means 47; and a discharged stencil compressing member 49 for pushing the used stencil sheet 18 conveyed in the stencil disposal box 48 by the discharged stencil conveying means 47.

Figure 5:
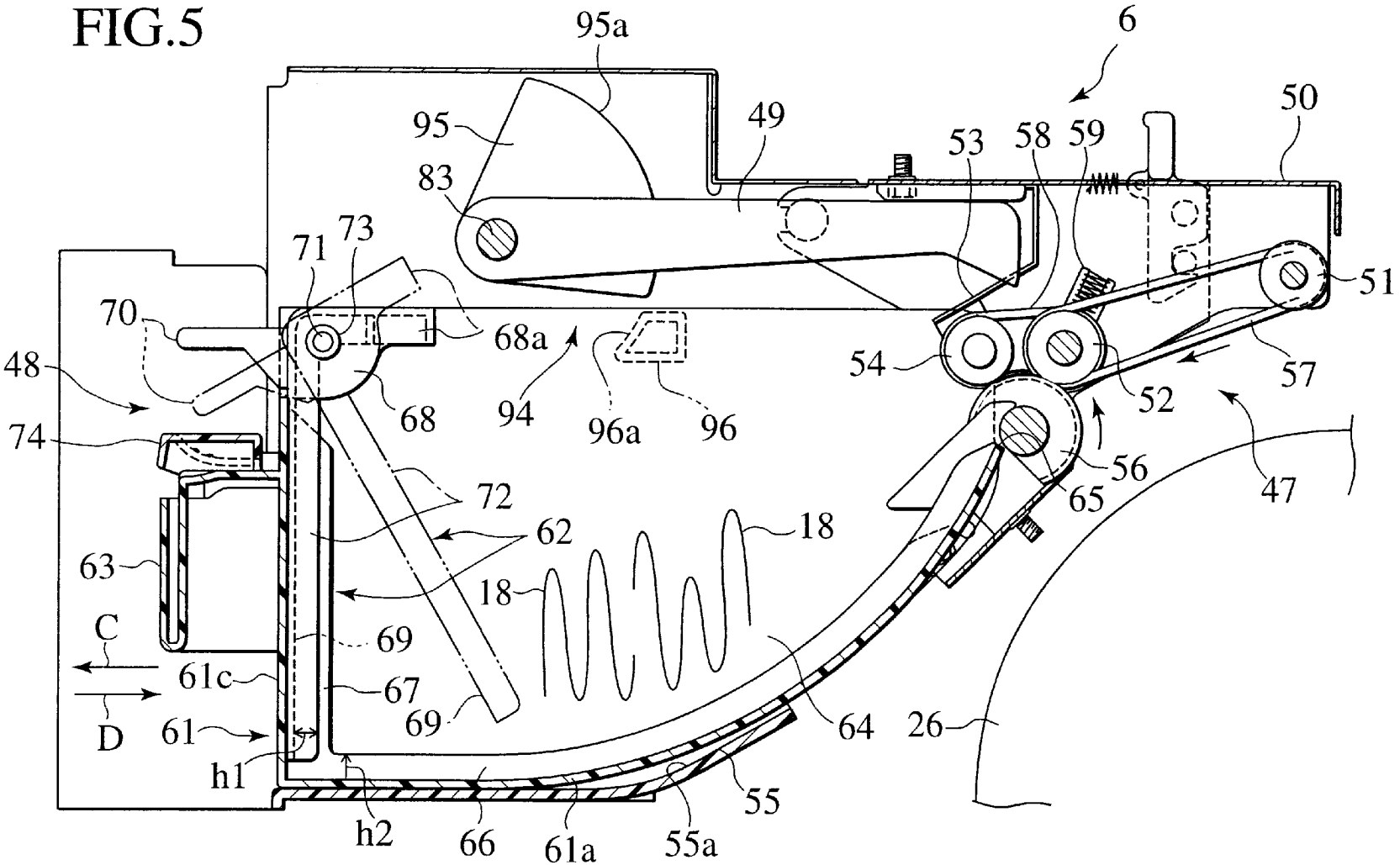
FIG. 5 is a sectional view showing the stencil disposal unit of the stencil printing machine of the first embodiment of the present invention.
Figure 6:
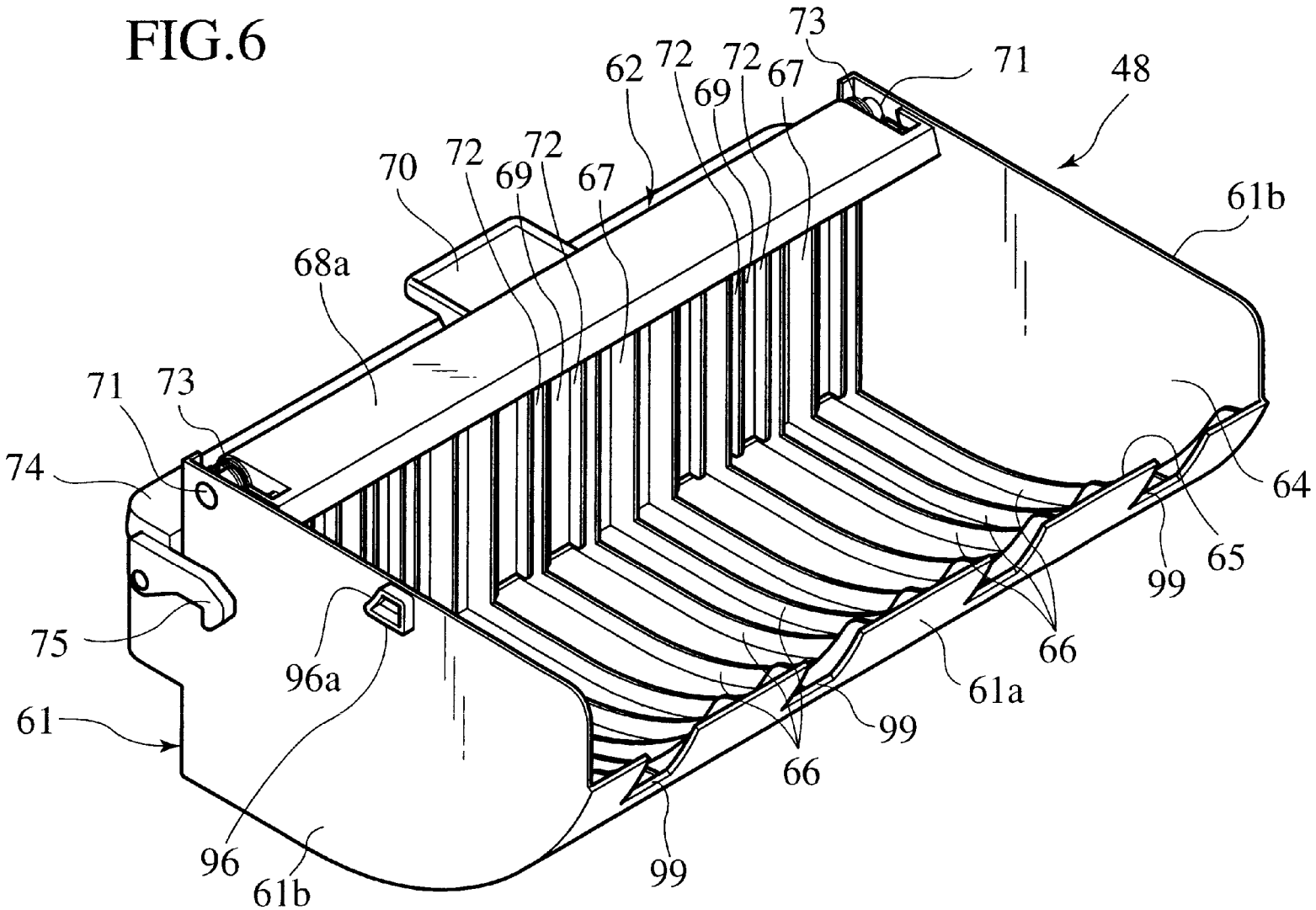
FIG. 6 is a perspective view showing the stencil disposal box of the first embodiment of the present invention.

As shown in FIG. 5, the discharged stencil conveying means 47 has a sheet edge guide roller 51, which is rotatively supported by a discharged stencil cover frame 50 and is disposed at an adjacent position above the outer peripheral surface of the printing drum 26, a pressing guide roller 52, which is also rotatively supported by the discharged stencil cover frame 50 and is disposed at an adjacent position above the outer peripheral surface of the printing drum 26, another pressing guide roller 54, which is disposed adjacently to the pressing guide roller 52 and is rotatively supported by the discharged stencil cover frame 50 via a flat spring 53, and a conveying guide roller 56, which is disposed at a position below both of the pressing guide roller 54 and the pressing guide roller 52 and is rotatively supported by a stencil disposal main frame 55.

An endless sheet edge guide belt 57 is provided around the sheet edge guide roller 51 and the pressing guide roller 52, and is arranged so as to face to the outer peripheral surface of the printing drum 26. An endless pressing guide belt 58 is provided around the pressing guide roller 52 and the pressing guide roller 54. Also, the pressing guide belt 58 is pressed to the outer peripheral surface of the conveying guide roller 56 throughout the predetermined range by an urging force of a compressing coil spring 59, which urges an axis of the pressing guide roller 52 in the direction of a rotation center of the conveying guide roller 56, and by an urging force of the flat spring 53, which urges the pressing guide roller 54 in the direction of a rotation center of the conveying guide roller 56. In addition, the pressing guide belt 58 provided around the pressing guide rollers 52 and 54 and the conveying guide roller 56 are disposed in the vicinity of an opening 65 of the stencil disposal box 48. Note that the conveying guide roller 56 and the like in the discharged stencil conveying means 47 are set to be driven by a discharged stencil conveyer drive unit (not shown) in the arrow direction shown in FIG. 5.

As shown in FIGS. 4 to 8, a box storing space 55*a* of the stencil disposal main frame 55 disposed in a main body 60 of the stencil printing machine A serves as a mounting position of the stencil disposal box 48, and the stencil disposal box 48 is movably provided in the box storing space 55*a*. Specifically, the stencil disposal box 48 at the mounting position is pulled out in the direction of the arrow C shown in FIG. 5, and thus the stencil disposal box 48 can be detached from the stencil printing machine main body 60. Also, the detached stencil disposal box 48 can be set to the mounting position by inserting in the direction of the arrow D shown in FIG. 5.

The stencil disposal box 48 is provided with a stencil disposal box main body 61 made of synthetic resin, a sweeping member 62 made of synthetic resin supported by the stencil disposal box main body 61 and a handle portion 63, which is integrally with a back surface 61*c* of the stencil disposal box main body 61 so as to protrude therefrom. In the stencil disposal box main body 61, a stencil sheet storing space 64 is formed of a bottom plane 61*a* gradually sloping upward in its front side, right and left side planes 61*b* disposed on the both sides of the bottom plane 61*a* and a back plane 61*c* disposed at the back side of the bottom plane 61*a*. The stencil sheet storing space 64 is opened in the upper side and a part of the front side, which serves as the opening 65. At the mounting position of the stencil disposal box 48, the pressing guide belt 58 and the conveying guide roller 56 are disposed on the front portion of the opening 65 as described above, and the used stencil sheet 18 is conveyed from this portion. In addition, concave portions 99 (shown in FIGS. 6 and 7) are appropriately provided on the front end of the bottom plane 61*a*. These concave portions 99 are provided for disposing the conveying guide roller 56 in the state where the stencil disposal box 48 is at the mounting position.

A plurality of ribs 66 and 67 extending in the conveying direction of the stencil sheet 18 are integrally formed in parallel to each other with the inner surfaces of the bottom plane 61*a* and the back plane 61*c* of the stencil disposal box main body 61 so as to protrude therefrom. Each of the ribs 66 on the bottom plane 61*a* and each of the ribs 67 on the back plane 61*c* are provided so as to connect each other at the same position in terms of a direction perpendicular to the conveying direction of the stencil sheet 18.

The sweeping member 62 is constituted of a rotatable support portion 68 disposed along the inner surface of the back plane 61*c* at a position above the back plane 61*c*, a plurality of sweeping claws 69, which are arranged along a direction perpendicular to the conveying direction of the stencil sheet 18 with an interval between each of the claws, an operation lever portion 70, which is an operation member integrally disposed at the back of the rotation support portion 68 so as to protrude outside the back plane 61*c*.

The sweeping member 62 is rotatively supported by the stencil disposal box main body 61 with using a pair of support pins 71 and 71 as a center of the rotation, which are integrally formed with the both sides of the rotation support portion 68 so as to protrude therefrom. Each of the sweeping claws 69 is provided so as to be movable between an innermost position approximately adjacent to the inner surface of the back plane 61*c* (a position indicated by a solid line in FIG. 5 and a position shown in FIG. 6) and a sweeping position to which the sweeping claw 69 rotates from the innermost position toward the opening 65 (a position indicated by a broken line in FIG. 5 and a position shown in FIG. 7). In addition, a ceiling portion 68*a* is integrally provided with the rotation support portion 68 so as to protrude therefrom. The ceiling portion 68*a* partially closes the opening 65 of the stencil disposal box main body 61 in a state where the sweeping claws 69 are located in the innermost position.

When the sweeping member 62 is at the innermost position, the plurality of sweeping claws 69 are disposed between the plurality of the ribs 67 of the back plane 61*c* so as not to interfere with each other. Also, on both sides of a surface of each of the sweeping claws 69, which contacts the stencil sheet 18, each of the ribs 72 are integrally provided so as to protrude therefrom. As shown in FIG. 5, the rib 72 on the sweeping member 62 is set to have a height h1 so as not to protrude from the rib 67 on the back plane 61*c* when the sweeping member 62 is at the innermost position. Specifically, assuming that a height of the rib 67 is set to h, the height h1 is set so as to satisfy h1<h. In addition, a lower end position of each of the sweeping claws 69 is set at least lower than a height h2 of the rib 66 on the bottom plane 61*a* when the sweeping member 62 is at the innermost position.

Furthermore, torsion springs 73 as urging means are disposed respectively in the vicinity of the pair of the support pins 71 and 71. Therefore, the sweeping member 62 is urged to set at the innermost position by the spring force of the pair of torsion springs 73 and 73.

The operation lever portion 70 is disposed at an adjacent position above the handle portion 63 and is freely operable in a state where the handle portion 63 is gripped. Specifically, a user operates the operation lever portion 70 so as to move toward the handle portion 63 (lower direction) against the spring force of the pair of torsion springs 73 and 73, whereby the sweeping claw 62 is operated to move toward the sweeping portion.

Also, a grip plate 74 is rotatively supported adjacently to an upper surface of the handle portion 63. In this state, when a user grips the grip plate 74 as well as the handle portion 63, a lock member 75 moves rotatively in an unlock direction against the urging force of the torsion spring (not shown). In short, the stencil disposal box 48 is locked to the stencil printing machine main body 60 by the lock member 75 when mounted to the stencil printing machine main body 60. If a user grips the handle portion 63, the lock is released, and thus the user can detach the stencil disposal box 48.

As shown in FIGS. 4 and 5, the discharged stencil compressing member 49 is supported by the stencil disposal main frame 55. In this state, one end of the discharged stencil compressing member 49 can move rotationally with using a rotation axis 83 as a center of the rotation. The discharged stencil compressing member 49 is rotatable between a stand-by position shown in FIG. 5 and a compressing position where the discharged stencil sheet compressing member 49 compresses the stored stencil sheet 18. At the stand-by position, the stencil sheet compressing member 49 is located at a position above the stencil sheet storing space 64 of the stencil disposal box 48. On the other hand, at the compressing position, the stencil sheet compressing member 49 is located at a position inside the stencil sheet storing space 64 of the stencil disposal box 48 and adjacent to the back plane 61*c*. The discharged stencil compressing member 49 is driven by a compressing member drive unit (not shown) so as to move between the stand-by position and the compressing position.

A stencil disposal box locking means 94 is constituted of a right and left pair of sectorial engaging members 95 and 95, which are fixed to the rotation axis 83, and a pair of locking members 96 and 96 provided both of the outer side surfaces of the stencil disposal box 48 and engaging with the engaging member 95 at a position other than the stand-by position of the discharged stencil compressing member 49 to inhibit the movement of the stencil disposal box 48 in the detaching direction. Specifically, at the stand-by position of the discharged stencil compressing member 49 shown in FIG. 5, the engaging member 95 is located at an upper position where the engaging member 95 does not engage the locking member 96. Also, at the position other than the stand-by position of the discharged stencil compressing member 49, the locking member 96 is located at a side position of the engaging member 95 where the locking member 96 is engaged with the engaging member 95, whereby the movement of the stencil disposal box 48 in the detaching direction is inhibited. The engaging member 95 is a rotatable member, which is rotated accompanying the rotary movement of the discharged stencil compressing member 49. Opposing surfaces 95*a* of the engaging member 95 and 96*a* of the locking member 96, which are adjacent and opposed to each other, are formed as surfaces on the approximately same circular arc having the same center and curvature. That is, unless the discharged stencil compressing member 49 is at the stand-by position, the stencil disposal box 48 can not be detached from the mounting position of the stencil printing machine main body 60.

Next, the operation of the stencil printing machine A will be described briefly. In the stencil making unit 2, the stencil sheet 18 is conveyed by the rotation of the platen roller 21 and the stencil sheet conveying roller 22, and a plurality of heating elements on the thermal head 20 selectively generates heat based on the image data read in the original-reading unit 1, whereby thermosensitively perforating the stencil sheet 18 to make a stencil. Consequently, the stencil sheet 18 thus obtained is cut at predetermined positions by the stencil sheet cutter 24, and thus the stencil sheet 18 having desired dimensions is fabricated.

In the printing unit 3, an edge portion of the stencil sheet 18 fabricated in the stencil making unit 2 is clamped by the stencil sheet clamping portion 27 of the printing drum 26. In this state, the printing drum 26 is rotated, and thus the stencil sheet 18 is wound and attached to the outer peripheral surface of the printing drum 26.

In the paper feed unit 4, the print paper 37 is conveyed between the printing drum 26 and the press roller 35 synchronously with the rotation of the printing drum 26.

On the other hand, in the printing unit 3, the press roller 35 is moved to the pressing position at the time when the print paper 37 passes therethrough in the printing operation. Consequently, the print paper 37 is conveyed between the printing drum 26 and the press roller 35 while being pressed. Since the ink 34 is always supplied to the outer peripheral surface of the squeegee roller 32, the ink 34 is transferred to the printing paper 37 through the perforation of the stencil sheet 18 by the rotation, and then the printing of the image is completed.

In the paper discharge unit 5, the edge portion of the print paper 37 is peeled by a paper separator claw 44 from the printing drum 26. The print paper 37 separated from the printing drum 26 is discharged to the paper receiving tray 46 through the conveyance path 45, and then the print paper 37 is laminated on the paper receiving tray 46.

Also, in the stencil disposal unit 6, when starting to make another stencil, if the stencil sheet 18 used in the previous printing is still wound around the outer peripheral surface of the printing drum 26, the stencil sheet clamping portion 27 of the printing drum 26 is released in the previous step of making stencil. The edge portion of the stencil sheet 18 released from the clamp is guided by the discharged stencil conveying means 47, while rotating the printing drum 26, and thus the stencil sheet 18 is stored in the stencil disposal box 48.

Next, the stencil disposal operation will be described. The printing drum 26 is rotated to the stencil disposal position, and then the stencil sheet clamping portion 27 is moved from the clamping position to the clamping release position. The discharged stencil conveying means 47 is driven by the stencil conveyer drive means (not shown) at the same time as the release of the clamping. Then, the conveying guide roller 56, pressing guide belt 58 and the sheet edge guide belt 57 and the like are driven in the arrow direction shown in FIG. 5.

The edge portion of the stencil sheet 18, which is curled along the outer peripheral surface of the printing drum 26 due to the release of the clamping described above, is forced to be separated from the outer peripheral surface of the printing drum 26 by a flip-up plate (not shown). Then, the edge portion of the separated stencil sheet 18 contacts the sheet edge guide belt 57, and thus the conveying force is generated by the friction between the stencil sheet 18 and the sheet edge guide belt 57. As a result, the edge portion of the stencil sheet 18 is guided between the conveying guide roller 56 and the pressing guide belt 58.

Thereafter, the printing drum 26 is rotated in the direction of the arrow A shown in FIG. 4. Due to the rotation of the printing drum 26, the edge portion of the stencil sheet 18 is led between the conveying guide roller 56 and the pressing guide belt 58. Since the pressing guide belt 58 is pressed onto the outer peripheral surface of the conveying guide roller 56, the frictional force generated by the movement of the conveying guide roller 56 and the pressing guide belt 58 is applied to the stencil sheet 18, and thus the stencil sheet 18 is conveyed therebetween. Then, the stencil sheet 18 is conveyed between the conveying guide roller 56 and the pressing guide belt 58, while peeled from the printing drum 26 by the rotation of the printing drum 26. Consequently, the stencil sheet 18 is discharged through the opening 65 of the stencil disposal box 48 to the stencil sheet storing space 64.

Next, when the discharged stencil compressing member 49 moves from the stand-by position shown in FIG. 5 to the compressing position, the used stencil sheet 18 contained in the vicinity of the opening 65 of the stencil disposal box 48 is pushed to the inner space of the stencil sheet storing space 64 in the course of this movement, and then compressed. Thereafter, the discharged stencil compressing member 49 is returned to the stand-by position, and thus, the operation of the discharged stencil compressing member 49 is completed.

Next, description will be made for a disposal process of the used stencil sheet 18 contained in the stencil disposal box 48 to a wastebasket (not shown). For example, when the stencil sheet storing space 64 of the stencil disposal box 48 is filled with the stencil sheet 18 stored therein, a user grips the handle portion 63 and detaches the stencil disposal box 48 from the stencil printing machine main body 60. The user carries this stencil disposal box 48 to the position of the wastebasket. At a position above the wastebasket, the user turns downward the opening 65 of the stencil disposal box main body 61. The user turns downward the opening 65 of the stencil disposal box main body 61 and at the same time, operates the operation lever portion 70 of the sweeping member 62 such that the operation lever portion 70 comes close to the handle portion 63. Consequently, the sweeping member 62 moves from the innermost position to the sweeping position, and then, the used stencil sheet 18 stored in the stencil disposal box main body 61 is discharged therefrom. After the disposal of the stencil sheet 18 in the stencil disposal box 48, the empty stencil disposal box 48 is returned to the mounting position of the stencil printing machine main body 60. Then, the disposal process is completed.

In the above-described disposal process of the stencil sheet 18, when the user turns downward the opening 65 of the stencil disposal box main body 61 and operates the operation lever portion 70 of the sweeping member 62 such that the operation lever portion 70 comes close to the handle portion 63, the sweeping member 62 moves from the innermost position to the sweeping position. Then, this movable sweeping member 62 can forcibly separate the stencil sheet 18 adhered to the inner surface of the stencil disposal box main body 61 due to the ink viscosity. Therefore, it becomes possible to drop the used stencil sheet 18 adhered due to the ink viscosity from the inner surface of the stencil disposal box main body 61 surely and easily.

In the foregoing first embodiment, since the ribs 66 and 67 extending in approximately parallel to the conveying direction of the stencil sheet 18 are provided on the inner surfaces of the bottom plane 61*a* and the back plane 61*c* of the stencil disposal box main body 61, the stencil sheet 18 conveyed in the stencil disposal box main body 61 contacts the ribs 66 and 67. Accordingly, the area of the stencil sheet 18 which contacts the stencil disposal box main body 61 is small, which allows to prevent the stencil sheet 18 from adhering to the stencil disposal box main body 61 as much as possible. Consequently, it becomes possible to drop the used stencil sheet 18 from the stencil disposal box main body 61 more surely and easily. In addition, in the first embodiment, since the plurality of ribs 66 and 67 are parallelly provided at certain intervals therebetween, the stencil sheet 18 is stored in contact with the ribs 66 and 67 only. Therefore, it becomes possible to effectively prevent the used stencil sheet 18 from adhering to the stencil disposal box main body 61.

Especially, in the stencil printing machine A, in which the used stencil sheet 18 is compressed by the discharged stencil compressing member 49 and is stored in the stencil disposal box main body 61 of the stencil disposal box 48, the stencil sheet 18 is apt to adhere to the inner surface of the stencil disposal box main body 61 due to the ink viscosity and further, the stencil sheet 18 has the possibility to adhere thereto strongly. However, the operation lever portion 70 is operated so as to move the sweeping member 62 from the innermost position to the sweeping position, whereby the stencil sheet 18 adhered to the inner surface of the stencil disposal box main body 61 due to the ink viscosity can be forcibly separated. Accordingly, it becomes possible to drop and dispose of the used stencil sheet 18 from the inner side of the stencil disposal box main body 61 more surely.

Furthermore, the rib 72 is provided on a surface of the sweeping member 62, to which the stencil sheet 18 is contacted. Therefore, when the sweeping member 62 moves from the innermost position to the sweeping position, the stencil sheet 18 contacts the rib 72 of the sweeping member 62, and the contact area between the stencil sheet 18 and the sweeping member 62 becomes small. Accordingly, the used stencil sheet 18 is hardly adhered to the sweeping member 62, and even if adhered, the adhesion force is weak. Consequently, the situation where the stencil sheet 18 is adhered to the sweeping member 62 without dropping therefrom can be avoided, and thus it becomes possible to drop the used stencil sheet 18 more surely and easily.

Moreover, the ribs 72 of the sweeping member 62 are provided on both sides of each of the sweeping claws 69, and as a whole, a plurality of ribs 72 are provided. Therefore, the stencil sheet 18 contacts the rib 72 only and in this state, the stencil sheet 18 is pressed. Consequently, it becomes possible to effectively prevent the used stencil sheet 18 from adhering to the sweeping member 62.

The height of the rib 72 of the sweeping member 62 is set to h1 such that the rib 72 does not protrude from the rib 67 on the stencil disposal box main body 61 when the sweeping member 62 is at the innermost position. Therefore, the stencil sheet 18 conveyed in the stencil disposal box main body 61 contacts the rib 67 on the stencil disposal box main body 61, but does not contact the rib 72 on the sweeping member 62, and in such a state, the stencil sheet 18 is stored in the stencil disposal box main body 61. When the stencil disposal box 48 is detached from the stencil printing machine main body 60 and the operation lever portion 70 is operated, the rib 72 on the sweeping member 62 first contacts the stencil sheet 18. Consequently, it is possible to prevent the occurrence of a state that the used stencil sheet 18 is stuck to the sweeping member 62 due to the ink adhesion force for long hours, and also, it becomes possible to surely drop the used stencil sheet 18 from the stencil disposal box main body 61 by the movement of the sweeping member 62 to the sweeping position.

Further, since the torsion spring 73 is provided, which urges the sweeping member 62 to move to the innermost position, even if the user does not return the sweeping member 62 to the innermost position forcibly by operating the operation lever portion 70 after moving the sweeping member 62 to the sweeping position, the sweeping member 62 automatically returns to the innermost position for sure due to the urging force of the torsion spring 73. Therefore, the operation of the operation lever 70 for returning the sweeping member 62 to the innermost position can be eliminated. It is possible to prevent the occurrence of the situation that the sweeping member 62 is not located at the innermost position due to the influence from some external force at the time of mounting the sweeping member 62 to the stencil printing machine main body 60.

Also, when the user turns downward the opening 65 of the stencil disposal box main body 61 so as to drop the stencil sheet 18, unless the user operates the operation lever portion 70, the sweeping member 62 is held at the innermost position due to the urging force of the torsion spring 73. The sweeping member 62 does not move even if the user turns downward the opening 65 of the stencil disposal box main body 61. Therefore, the user can select whether or not the sweeping member 62 is used, and thus, it becomes possible to use the sweeping member 62 only when it is needed.

Note that, though the urging means is constituted as the torsion spring 73 in the above-described first embodiment, any urging means is applicable if it can urge the sweeping member 62 to move to the innermost position.

Figure 7:
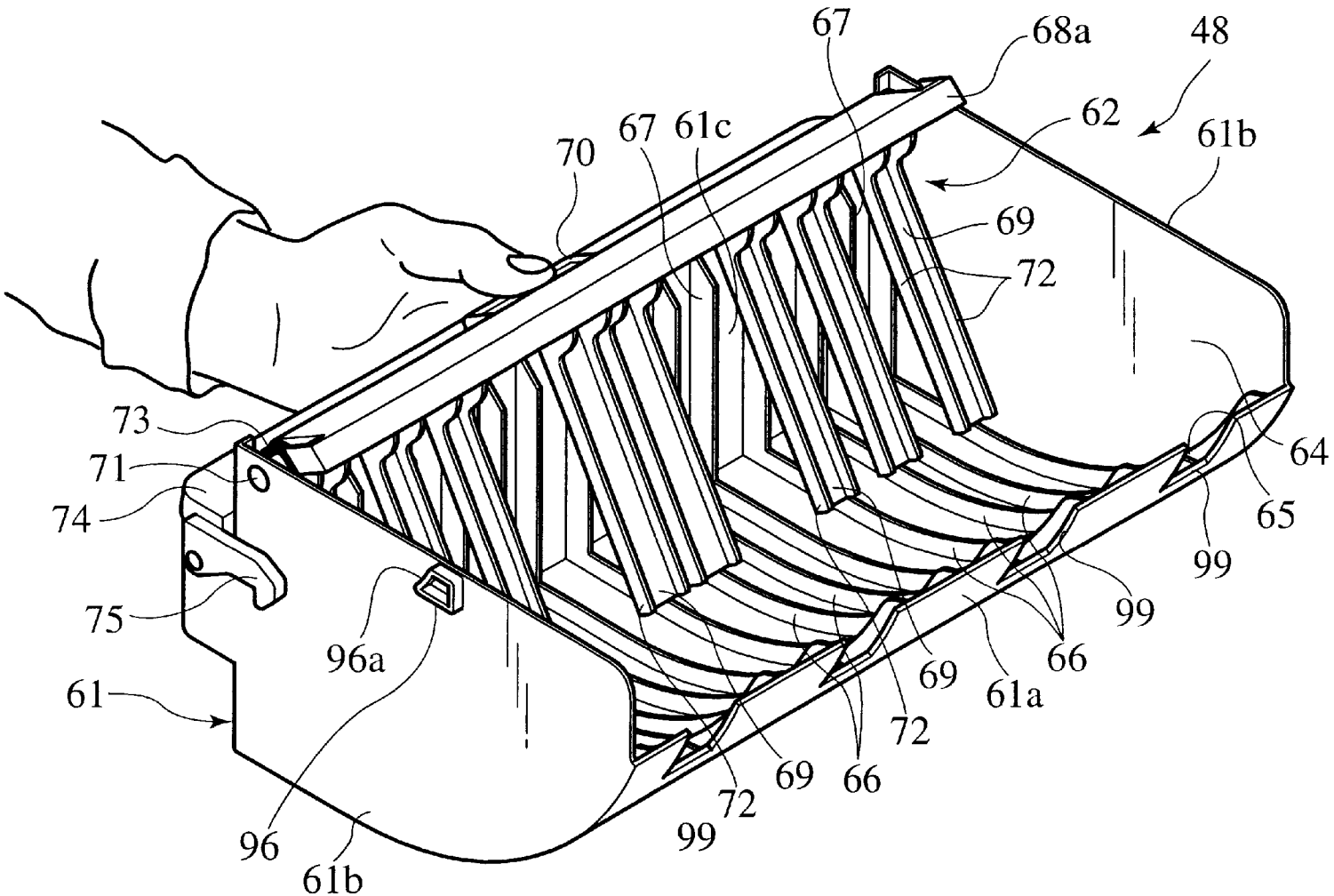
FIG. 7 is a perspective view showing a state where an operation lever portion of the stencil disposal box is operated in the first embodiment of the present invention.
Figure 8:
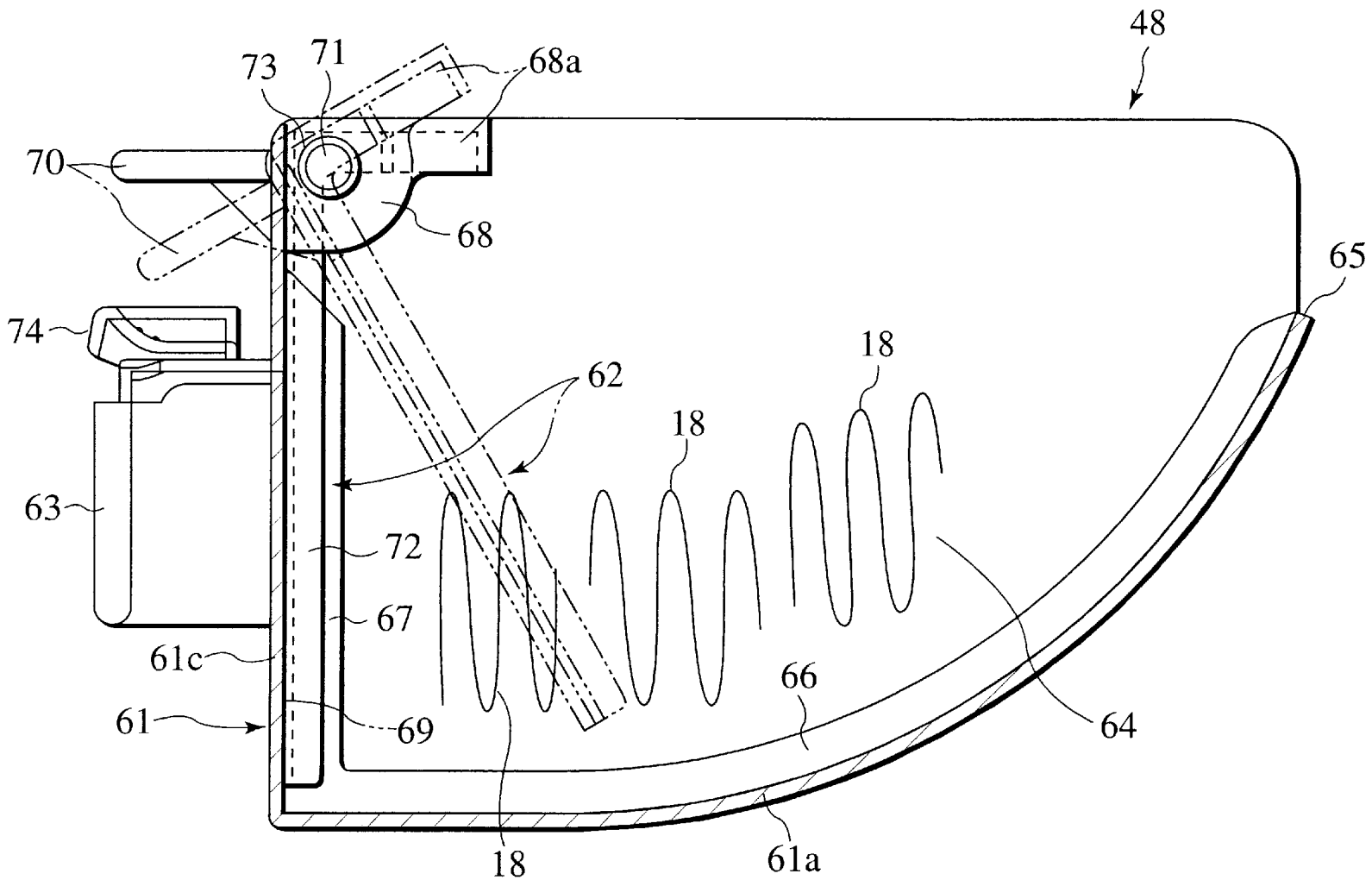
FIG. 8 is a sectional view showing the stencil disposal box of the first embodiment of the present invention.

Further, the operation lever portion 70 as the operation member is provided in the vicinity of the handle portion 63 of the stencil disposal box main body 61 where the user can operate the operation lever portion 70 by the hand which grips the handle portion 63. Accordingly, as shown in FIG. 7, the user can operate the operation lever portion 70 by the same hand, which grips the handle portion 63, and thus, the user can dispose of the stencil sheet 18 by one hand.

Moreover, the stencil disposal box main body 61 is formed by the bottom plane 61*a*, the side planes 61*b* disposed on the both sides of the bottom plane 61*a* and the back plane 61*c* disposed at the back side of the bottom plane 61*a*, in which at least the ribs 66 is provided on the bottom plane 61*a*. The position adjacent to the back plane 61*c* of the stencil disposal box 61 is set to the innermost position of the sweeping member 62. The sweeping member 62 rotatively moves to the sweeping position with using the upper end portion of the sweeping member 62 as the rotation center. The lower end position of the sweeping member 62 is set at least lower than a height h2 of the rib 66 on the bottom plane

61*c* of the stencil disposal box main body 61. Therefore, when the sweeping member 62 moves from the innermost position to the sweeping position, the sweeping member 62 surely interferes the stencil sheet 18 stored in the stencil disposal box main body 61 and moves the stencil sheet 18 toward the opening 65. Consequently, it becomes possible to surely sweep away all of the used stencil sheet 18 from the stencil disposal box main body 61.

Also, though the ribs 66 and 67 are provided on both of the bottom plane 61*a* and the back plane 61*c* of the stencil disposal box main body 61, the rib 66 may be provided on the bottom plane 61*a* only.

Also, since the sweeping member 62 has the plurality of sweeping claws 69, which are arranged along a direction perpendicular to the conveying direction of the stencil sheet 18, the sweeping claws 69 of the sweeping member 62 can sweep away by pressure the used stencil sheet 18 stored in the stencil disposal box main body 61 by pushing the same at many points. Therefore, it becomes possible to sweep away and dispose of the used stencil sheet 18 more securely and easily.

Moreover, the sweeping member 62 is provided with the ceiling portion 68*a*. The ceiling portion 68*a* functions, for example, to prevent the stencil sheet 18 compressed by the discharged stencil compressing member 49 from jumping out of the opening 65 of the stencil disposal box 48 when detaching the stencil disposal box 48 from the stencil printing machine main body 60. However, the ceiling portion 68*a* is not always necessary. (This can be also applied to a second embodiment described below.)

Figure 9:
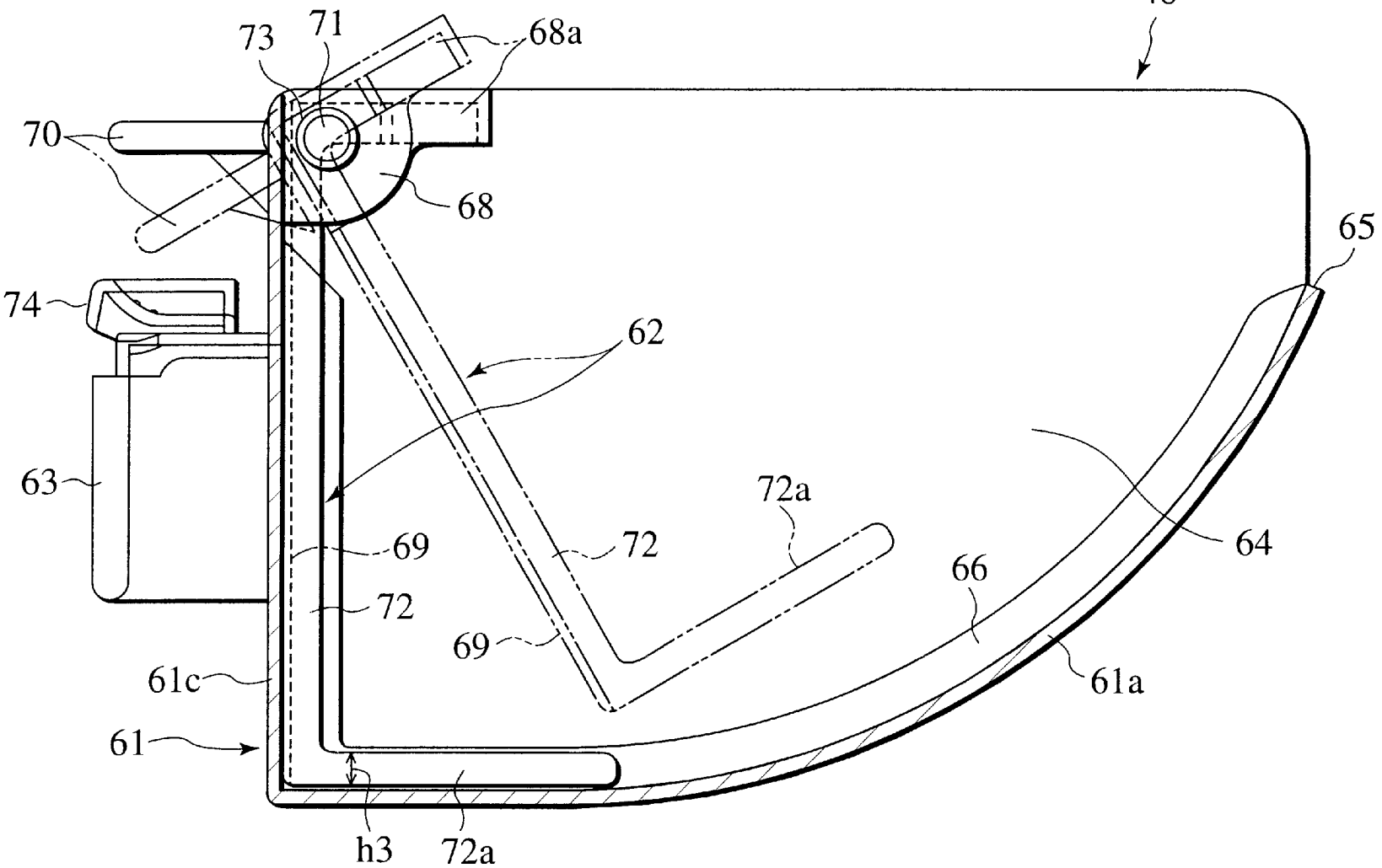
FIG. 9 is a sectional view showing a stencil disposal box of a second embodiment of the present invention.

FIG. 9 is a sectional view showing a stencil disposal box 48' of the second embodiment of the present invention. In the above-described first embodiment, the rib 72 on the sweeping claw 69 of the sweeping member 62 is set to have an even height h1 at any point thereof. However, the rib 72 on the sweeping claw 69 of the sweeping member 62 in the second embodiment has an extended rib portion 72*a* at the lower end thereof. In the case where the sweeping member 62 is at the innermost position, the extended rib portion 72*a* is disposed at a position approximately adjacent to the bottom plane 61*a* of the stencil disposal box main body 61. The extended rib portion 72*a* is set to have a height h3 so as not to protrude from the rib 66 on the bottom plane 61*c* of the stencil disposal box main body 61 in the case where the sweeping member 62 is at the innermost position. Note that the constitution of the second embodiment other than the foregoing is identical to that of the first embodiment. Therefore, the same reference numerals are applied to the same constitutional components, and the descriptions therefor will be omitted.

Also in this second embodiment, the action and effect identical to those of the above-described first embodiment can be obtained. In addition, in this second embodiment, the used stencil sheet 18 is separated forcibly from the bottom plane 61*c* by scooping the used stencil sheet 18 adhered to the bottom plane 61*c* of the stencil disposal box main body 61 by the use of the extended rib portion 72*a*. Accordingly, it becomes possible to separate the used stencil sheet 18 from the bottom plane 61*c* of the stencil disposal box main body 61 more securely.

Also, since the extended rib portion 72*a* of the sweeping member 62 is set to have a height h3 so as not to protrude from the rib 66 on the bottom plane 61*c* of the stencil disposal box main body 61 in the case where the sweeping member 62 is at the innermost position, the stencil sheet 18 conveyed in the stencil disposal box main body 61 contacts the rib 67 on the stencil disposal box main body 61, but does not contact the extended rib portion 72*a* on the sweeping member 62. In such a state, the stencil sheet 18 is stored in the stencil disposal box main body 61. When the operation lever portion 70 is operated, the extended rib portion 72*a* on the sweeping member 62 first contacts the stencil sheet 18. Consequently, it is possible to prevent the occurrence of a state that the used stencil sheet 18 is stuck to the extended rib portion 72*a* of the sweeping member 62 due to the ink adhesion force for long hours, and also, it becomes possible to drop the used stencil sheet 18 from the stencil disposal box main body 61 more surely by the movement of the sweeping member 62 to the sweeping position.

Figure 10:
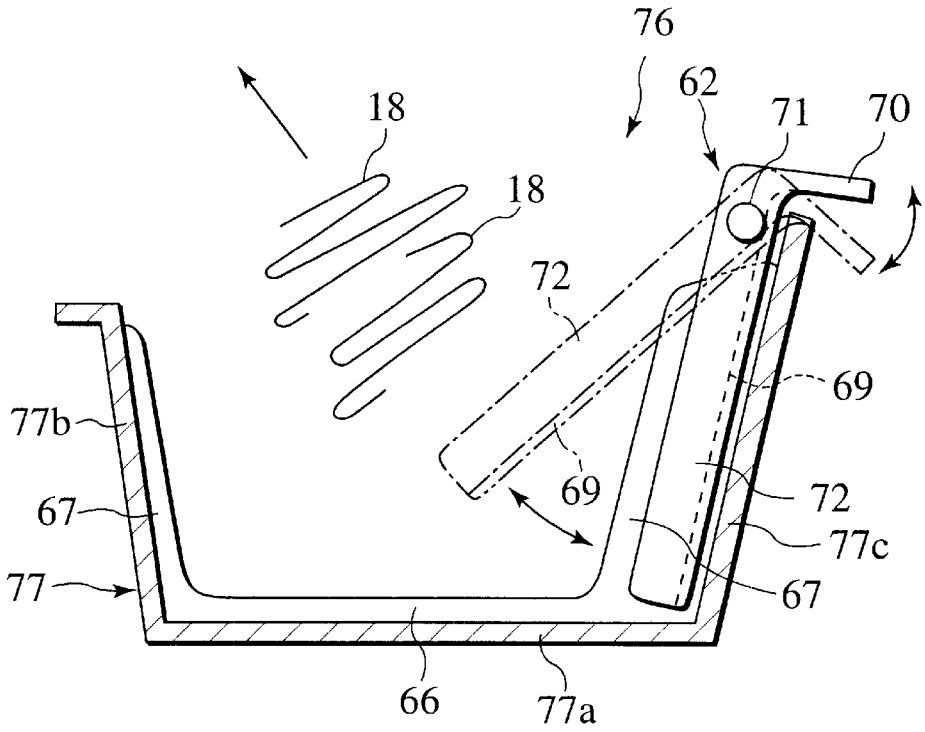
FIG. 10 is a sectional view showing the stencil disposal box of a third embodiment of the present invention.

FIG. 10 is a sectional view showing a stencil disposal box 76 according to the third embodiment of the present invention. In the stencil sheet disposal box 48 of the above-described first embodiment, the bottom plane 61*a* of the stencil disposal box main body 61 is formed so as to gradually slope upward in the front side thereof, so-called a dustpan shape. The stencil disposal box 76 of the third embodiment is different from the stencil disposal box 48 of the first embodiment in that a bottom plane 77*a* of the stencil disposal box main body 77 is flat, a front plane 77*b* and a back plane 77*c* slope outward as they go upward, and the stencil disposal box main body 77 formed of the planes has a box shape. Note that the constitution of the third embodiment other than the foregoing is identical to that of the first embodiment. Therefore the same reference numerals are applied to the same constitutional components, and the descriptions therefor will be omitted. Also in this third embodiment, the actions and the effects identical to those of the above-described first embodiment can be obtained.

Figure 11:
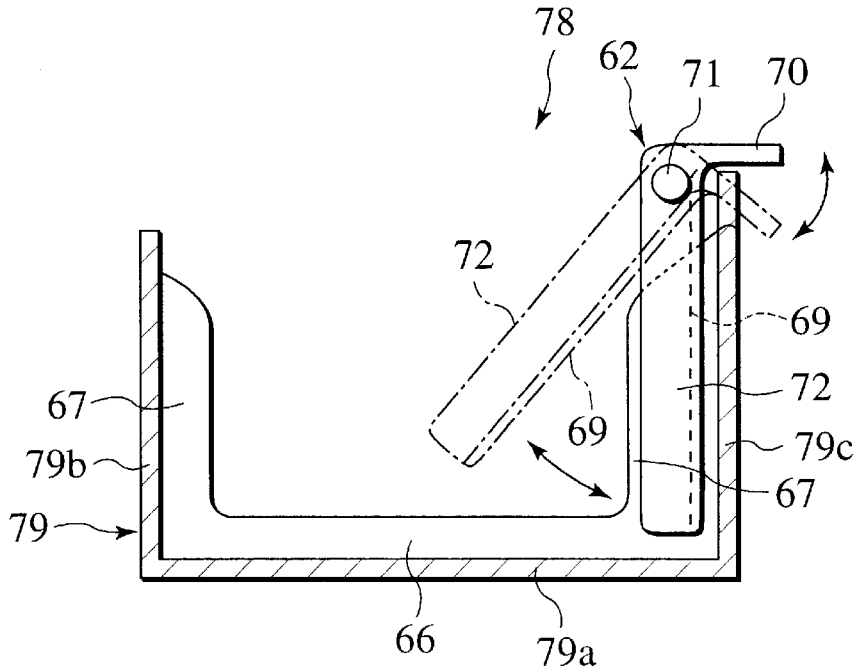
FIG. 11 is a sectional view showing the stencil disposal box of a fourth embodiment of the present invention.

FIG. 11 is a sectional view showing a stencil disposal box 78 according to the fourth embodiment of the present invention. In the stencil sheet disposal box 76 of the above-described third embodiment, a bottom plane 77*a* of the stencil disposal box main body 77 is flat, a front plane 77*b* and a back plane 77*c* slope outward as they go upward, and the stencil disposal box main body 77 formed of the planes has a box shape. The stencil disposal box 78 of the fourth embodiment is different from the stencil disposal box 76 of the third embodiment in that a front plane 79*b* and a back plane 79*c* of the stencil disposal box main body 69 extend vertically, and the stencil disposal box main body 79 has a box shape. Note that the constitution of the fourth embodiment other than the foregoing is identical to that of the third embodiment. Therefore the same reference numerals are applied to the same constitutional components, and the descriptions therefor will be omitted. Also in this fourth embodiment, the actions and the effects identical to those of the above-described first embodiment can be obtained.

Figure 12:
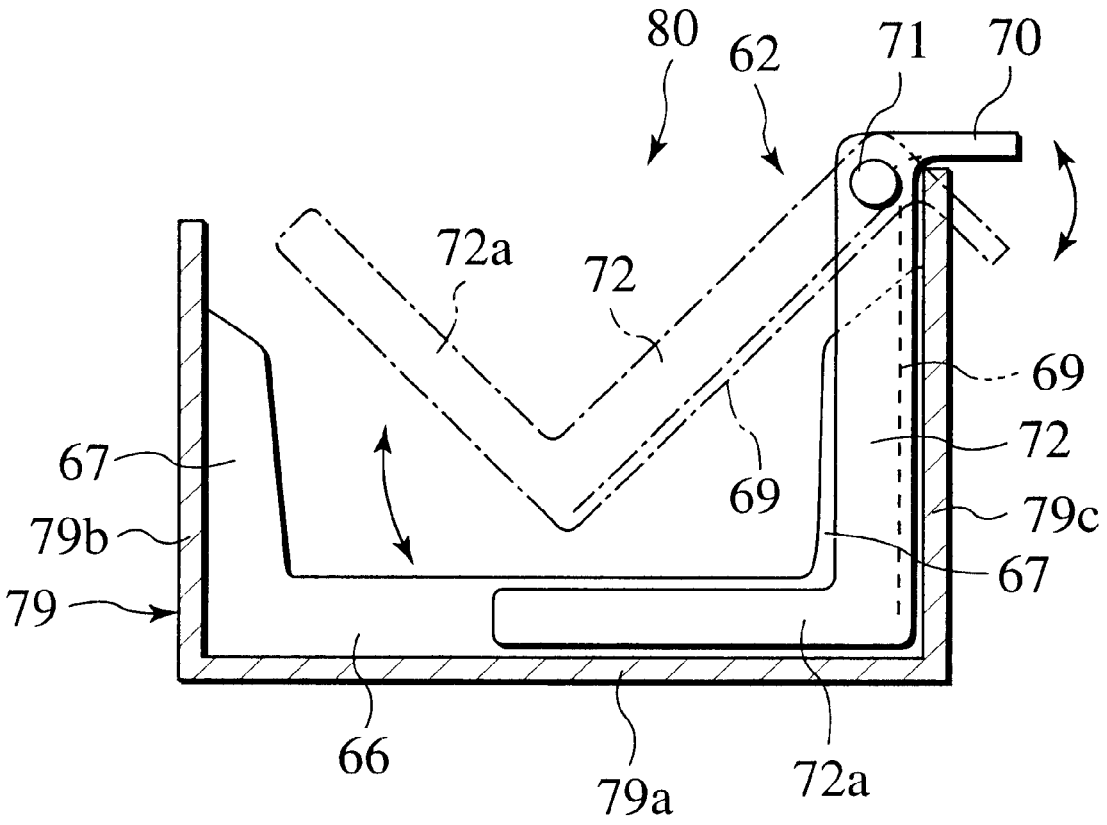
FIG. 12 is a sectional view showing the stencil disposal box of a fifth embodiment of the present invention.

FIG. 12 is a sectional view showing a stencil disposal box 80 according to the fifth embodiment of the present invention. In the fourth embodiment, the rib 72 of the sweeping member 72 is set so as to have the even height at any points. However, in this fifth embodiment, the stencil disposal box 80 is different from the stencil disposal box 78 of the fourth embodiment in that the rib 72 of the sweeping member 62 has an extended rib portion 72*a* at the lower end thereof similar to that of the above-described second embodiment. Note that the constitution of the fifth embodiment other than the foregoing is identical to that of the fourth embodiment. Therefore the same reference numerals are applied to the same constitutional components, and the descriptions therefor will be omitted. Also in this fifth embodiment, the actions and the effects identical to those of the above-described second embodiment can be obtained.

Note that according to the above-described embodiments, since the operation lever portion 70 as the operation member is formed integrally with the sweeping member 62, reduction of the number of the components and simplification of the constitution can be achieved. However, the operation member may be provided separately from the sweeping member. Also, description was made for the case where the sweeping member 62 is supported by each of the stencil disposal box main bodies 61, 77 and 79, being rotationally movable between the innermost position and the sweeping position. However, the sweeping member 62 may be constituted so as to move linearly not rotationally, and the movement trajectory thereof does not matter. However, the sweeping member 62, which moves rotationally, is simpler and can be constituted with smaller number of components.

What is claimed is:

1. A stencil disposal box detachably provided on a stencil printing machine main body and storing used stencil sheet when mounted to the stencil printing machine main body, comprising:

a stencil disposal box main body having an opening formed thereon, through which said stencil sheet is conveyed, and storing said conveyed stencil sheet;

a sweeping member carried by said stencil disposal box and biased towards an innermost position approximately adjacent to an inner surface of the stencil disposal box main body and rotatable through a sweeping arc to a position located more adjacently to said opening side than the innermost position to sweep said used stencil sheet from said stencil disposal box; and an operation member for operating movement of the sweeping member.

2. The stencil disposal box according to claim 1, wherein ribs extending in approximately parallel to a conveying direction of said stencil sheet are provided on the inner surface of said stencil disposal box main body.

3. The stencil disposal box according to claim 1, wherein ribs are provided on a surface of said sweeping member, where said stencil sheet contacts.

4. The stencil disposal box according to claim 3, wherein said ribs of the sweeping member are set to have a height so as not to protrude from ribs from said stencil disposal box main body when said sweeping member is located at the innermost position.

5. The stencil disposal box according to claim 1, wherein an urging member for urging said sweeping member to move to the innermost position is provided.

6. The stencil disposal box according to claim 1, wherein said operation member is provided in the vicinity of a handle portion of said stencil disposal box main body where a user can operate said operation member while gripping the handle portion.

7. The stencil disposal box according to claim 1, wherein said stencil disposal box main body is formed of a bottom plane, side planes disposed on the both sides of the bottom plane and a back plane disposed on the back of the bottom plane, said ribs are at least provided on the bottom plane, a position approximately adjacent to the back plane of said stencil disposal box main body is set as the innermost position of said sweeping member, said sweeping member rotatively moves to the sweeping position with using an upper end portion of said sweeping member as a rotation center, and a lower end position of said sweeping member is set at least lower than the height of said rib on said bottom plane of said stencil disposal box main body.

8. The stencil disposal box according to claim 1, wherein said sweeping member has a plurality of sweeping claws along a direction perpendicular to the conveying direction of said stencil sheet.

* * * * *